US007181798B2

(12) United States Patent
Hayhurst

(10) Patent No.: US 7,181,798 B2
(45) Date of Patent: Feb. 27, 2007

(54) ESCAPE HAMMER

(75) Inventor: John Franklin Hayhurst, Stockport (GB)

(73) Assignee: Donut Safety Systems Limited, Stockport (GB)

( * ) Notice: Subject to any disclaimer, the term of this patent is extended or adjusted under 35 U.S.C. 154(b) by 0 days.

(21) Appl. No.: 10/713,458

(22) Filed: Nov. 14, 2003

(65) Prior Publication Data

US 2005/0102760 A1 May 19, 2005

(51) Int. Cl.
*B25D 1/00* (2006.01)
*B25F 1/00* (2006.01)
*B66F 15/00* (2006.01)

(52) U.S. Cl. ..... 7/144; 7/100; 7/158

(58) Field of Classification Search ..... 7/100, 7/144, 146, 147, 158, 166, 170; 81/20
See application file for complete search history.

(56) References Cited

U.S. PATENT DOCUMENTS 4,592,467 A 6/1986 Lechner
5,251,351 A * 10/1993 Klotz ..... 7/100
5,952,916 A * 9/1999 Yamabe ..... 340/468
D417,130 S * 11/1999 Hollinger ..... D8/81

FOREIGN PATENT DOCUMENTS

| | | | |
|---|---|---|---|
| EP | 0 531 679 | A1 | 7/1992 |
| EP | 845333 | A1 * | 6/1998 |
| FR | 2 621 678 | | 1/1992 |
| GB | 2 265 851 | A | 10/1993 |
| JP | 07251383 | A * | 10/1995 |
| JP | 9085646 | | 3/1997 |
| JP | 09085646 | A * | 3/1997 |
| JP | 10291439 | | 11/1998 |
| JP | 10337679 | A * | 12/1998 |
| JP | 11010556 | A * | 1/1999 |
| WO | WO 02/064320 | A1 | 8/2002 |

* cited by examiner

*Primary Examiner*—David B. Thomas
(74) *Attorney, Agent, or Firm*—Gauthier & Connors, LLP

(57) ABSTRACT

An escape hammer for breaking reinforced glass or other barrier screen material to enable personnel to escape in an emergency, for example, from a high rise building or from a vehicle or other enclosure and comprising a handle (10) and enlarged head (11) with a pointed striking tip (12). The handle is ridged (as at 13) to provide a grip, has a chisel-end (15) to act as a levering tool, and a formation (17, 18) to assist in the removal of broken glass pieces. The whole tool is of steel or of a material of like mass.

9 Claims, 2 Drawing Sheets

ESCAPE HAMMER

BACKGROUND OF THE INVENTION

THIS INVENTION concerns a tool for breaking reinforced glass or other barrier screen material to enable personnel to escape in an emergency, for example, from a high rise building or from a vehicle or other enclosure.

Systems to permit escape from a fire in a high rise building may comprise a controlled descent device enabling personnel to pass from one floor to another outside of the building. This would be prevented by the inability to break the window glass on both floors, such glass usually being of the toughened kind.

It is known, for example, in some vehicles, to provide a hammer which is capable of breaking reinforced or laminated glass to enable the occupants to escape in the event of an accident or fire and where the doors cannot be opened. Such hammers usually consist of a head with a pointed striking tip, and a handle to grip the hammer. In many examples the hammer is constructed predominantly of plastics but with a metal head at one end. The mass of such a tool is likely to be insufficient to break the glass unless a very forceful blow is used. Also, such tools conventionally do not include additional features which might be required, for example, to prise open a door or to remove broken glass.

SUMMARY OF THE INVENTION

An object of the present invention is to provide an escape hammer with such additional features and being of sufficient mass to provide assurance that glass can be broken even when used by injured personnel with reduced strength such as might be the case in the event of an accident or fire.

According to the present invention, there is provided a personnel escape tool for breaking glass or other barrier screen material, comprising a striking tip of pointed form, a head supporting the striking tip, a handle to grip the tool, and a chisel-shaped flattened end part, at least the head of the tool being made of steel or of a material of like mass.

Preferably, the entire tool is made of steel or of a material of like mass.

Preferably, the chisel-shaped flattened end part is located at the end of the handle remote from the head.

The tool may have means on or in the region of the head formed to enable removal of broken glass pieces.

The means may comprise a formation consisting of a row of protrusions spaced apart by a ridge, the whole formation being provided on an underside of the head of the tool between the pointed tip and the handle.

The handle may comprise a ridged formation for gripping the tool.

BRIEF DESCRIPTION OF THE SEVERAL VIEWS OF THE DRAWINGS

An embodiment of the invention will now be described, by way of example only, with reference to the accompanying drawings, in which.

DETAILED DESCRIPTION OF THE INVENTION

Figure 1:
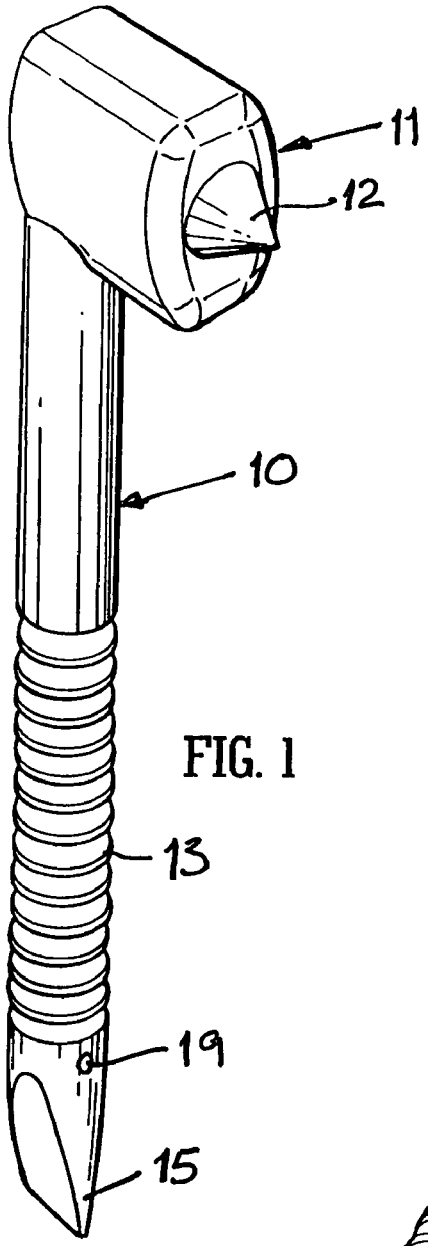
FIG. 1 is a perspective view of a tool made in accordance with the invention.
Figure 2:
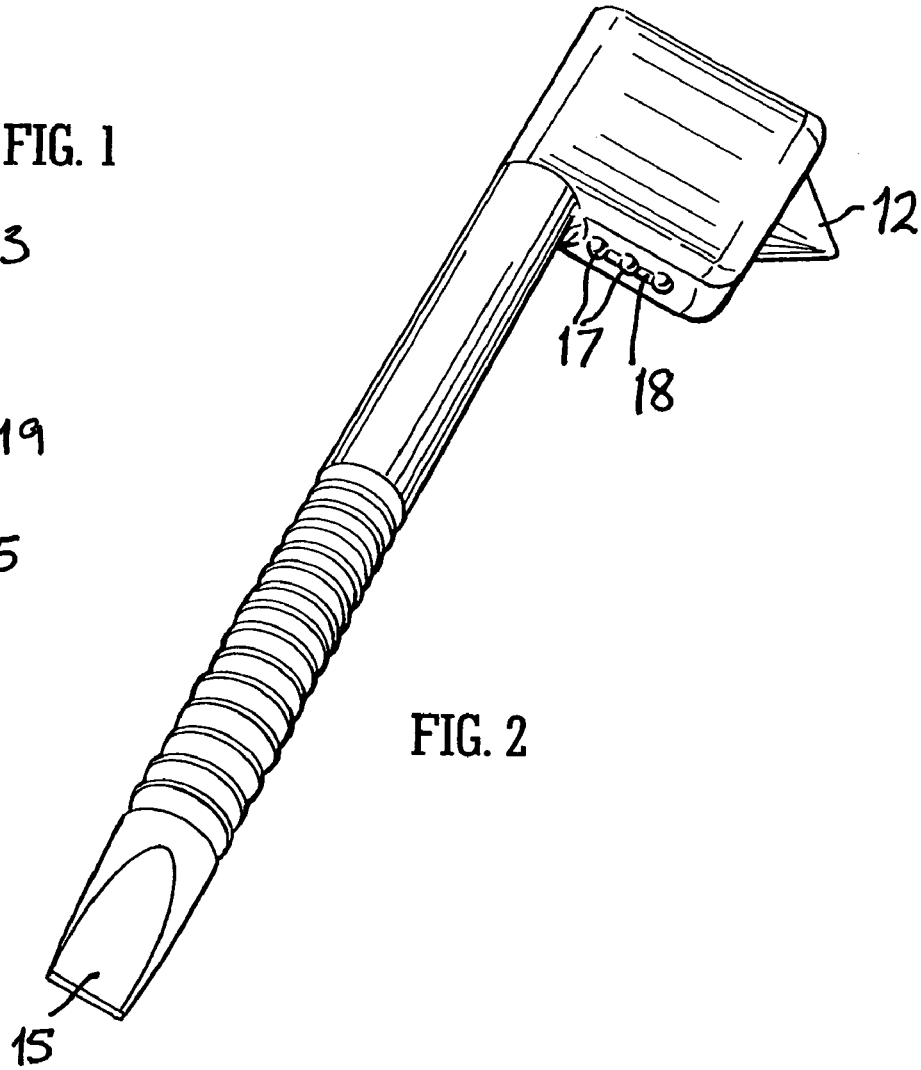
FIG. 2 is a further perspective view showing an underside of a head portion of the tool.
Figure 3:
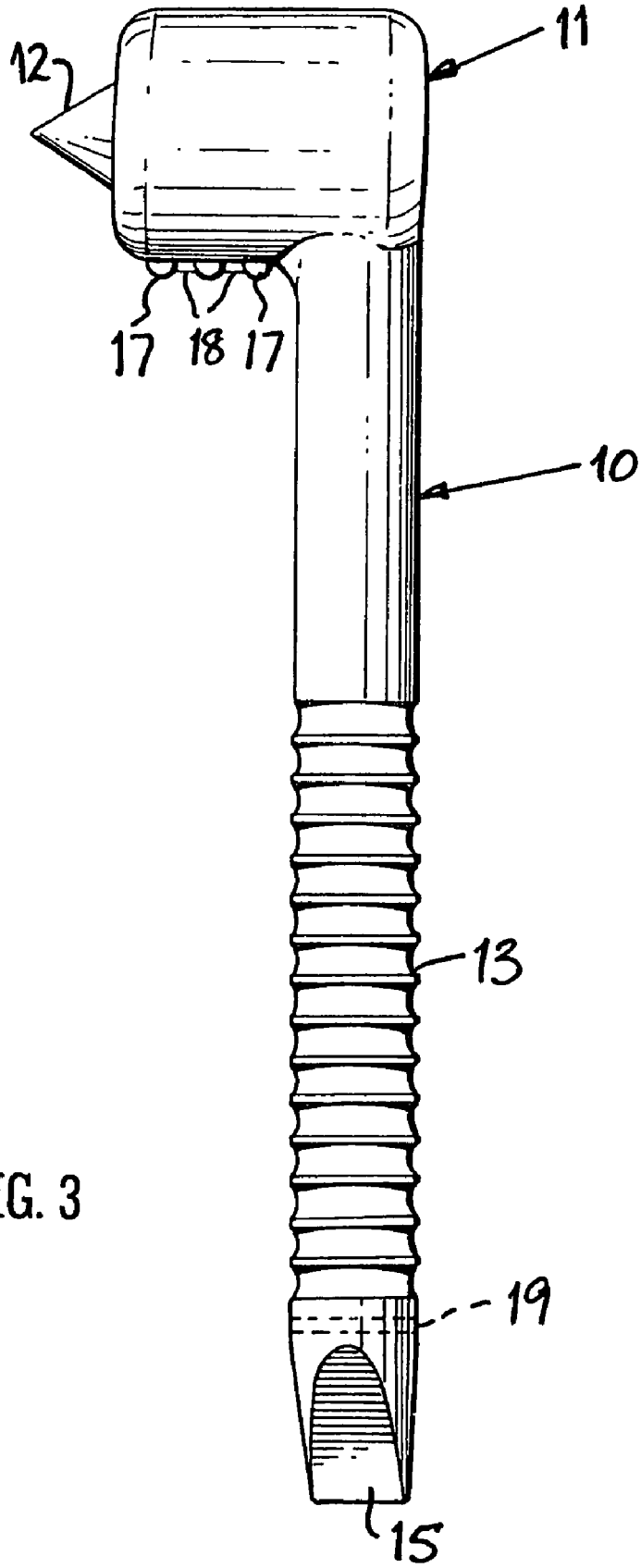
FIG. 3 is a side elevation of the tool.

Referring now to the drawings an escape tool made in accordance with the invention, and formed as a hammer, comprises a handle 10 to one end of which is an enlarged head 11 with a conical and pointed striking tip 12.

The handle 10 is ridged as at 13 to provide a gripping portion, and at the end of the handle remote from the head 11 is a flattened, or chisel-form end part 15 which in use may serve as a lever to force open a door, particularly the door of an elevator, or to force open a window.

It will be seen that beneath the head 11 of the tool is a formation comprising a row of three nodules 17 spaced apart by a pair of raised edges or ridges 18 each forming a knife edge. This formation may serve to loosen and clear away broken glass pieces.

The entire tool is preferably made from steel or a material of like mass and is balanced such that a considerable striking blow may be achieved owing to the enlarged head 11, and the entire tool is preferably provided with an acid-dipped surface finish for appearance and grip.

If required, an aperture 19 may be provided through the handle 10 at a position remote from the head 11 to enable the insertion of a lanyard or wrist strap which may be used to secure the tool about the person suspended on an escape device, or when the tool is stored ready for use.

The tool is distinguished from conventional tools of its kind by the provision of the chisel end part 15 of the handle, the ridged grip formation 13 on the handle and the formation 16 beneath the head for removal of broken glass pieces. The tool is designed also to be of considerable mass being entirely or predominantly made of steel thus to enhance its effectiveness when used even by personnel having reduced strength, for example, in the event of an accident or fire.

An escape tool of this kind may be used in buildings, or in ships, aircraft, or land vehicles where glass or other barrier screen materials normally prevent escape but which in the event of fire, flood or other disaster, must be removed to provide an escape route.

The invention claimed is:

1. An escape tool for breaking glass or other barrier screen material, comprising a striking tip of pointed form, a head supporting the striking tip, a handle to grip the tool, a flattened end part to provide a levering tool; and a formation provided on an underside of the head of the tool between the striking tip and the handle to enable removal of broken glass pieces.

2. A tool according to claim 1, wherein at least the head is steel.

3. A tool according to claim 1, wherein the flattened end part is located at the end of the handle remote from the head.

4. A tool according to claim 1, wherein said formation consists of a plurality of protrusions spaced apart by a ridge.

5. A tool according to claim 4, wherein the formation comprises a row of three nodules raised from under surface of the head and spaced apart by a pair of raised edges or ridges each forming a knife edge.

6. A tool according to claim 1, wherein the handle comprises a ridged formation for gripping the tool.

7. A tool according to claim 1, having an acid-dipped surface finish.

8. A tool according to claim 1, including an aperture through the handle at a position remote from the head, to receive a lanyard or wrist strap.

9. A tool according to claim 1, wherein the flattened end part is of chisel form.

* * * * *